US012022957B2

(12) United States Patent
Kappenman

(10) Patent No.: US 12,022,957 B2
(45) Date of Patent: Jul. 2, 2024

(54) SYSTEM AND METHOD FOR CUSTOMIZING A MATTRESS

(71) Applicant: Bed Patent Holdings Limited Liability Company, Las Vegas, NV (US)

(72) Inventor: Kevin J. Kappenman, Huntington Beach, CA (US)

(73) Assignee: Bed Patent Holdings Limited Liability Company, Las Vegas, NV (US)

( * ) Notice: Subject to any disclaimer, the term of this patent is extended or adjusted under 35 U.S.C. 154(b) by 144 days.

(21) Appl. No.: 17/562,576

(22) Filed: Dec. 27, 2021

(65) Prior Publication Data

US 2023/0200554 A1 Jun. 29, 2023

(51) Int. Cl.
*A47C 27/15* (2006.01)
*A47C 27/14* (2006.01)

(52) U.S. Cl.
CPC ..... *A47C 27/15* (2013.01); *A47C 27/148* (2013.01)

(58) Field of Classification Search
CPC ..... A47C 27/15; A47C 27/148; A47C 27/144; A47C 27/142; A47C 27/14
See application file for complete search history.

(56) References Cited

U.S. PATENT DOCUMENTS

| | | | | | |
|---|---|---|---|---|---|
| 3,885,258 | A * | 5/1975 | Regan | A47C 27/16 | 297/452.37 |
| 4,047,254 | A * | 9/1977 | Hamasu | A47C 27/144 | 5/284 |
| 6,061,856 | A * | 5/2000 | Hoffmann | A47C 27/148 | 5/724 |
| 2017/0156508 | A1* | 6/2017 | Segal | A47C 27/001 | |
| 2020/0229612 | A1* | 7/2020 | Micklos | A47C 27/148 | |

FOREIGN PATENT DOCUMENTS

| | | | | |
|---|---|---|---|---|
| DE | 10346684 | A1 * | 4/2004 | A47C 27/064 |
| EP | 1149547 | A1 * | 10/2001 | A47C 7/001 |
| EP | 1776902 | A1 * | 4/2007 | A47C 27/146 |
| GB | 2430151 | A * | 3/2007 | A47C 27/05 |
| WO | WO-2007129981 | A1 * | 11/2007 | A47C 27/148 |

* cited by examiner

*Primary Examiner* — David R Hare
*Assistant Examiner* — Alison N Labarge
(74) *Attorney, Agent, or Firm* — Blue Capital Law Firm, P.C.

(57) ABSTRACT

A mattress is disclosed. The mattress includes a first layer, a second layer supported on the first layer and arranged abutting the first layer, and a third layer having a substantially arch shape. The third layer includes a first portion embedded inside the first layer and a second portion at least partially embedded inside the second layer.

13 Claims, 5 Drawing Sheets

SYSTEM AND METHOD FOR CUSTOMIZING A MATTRESS

FIELD

The present disclosure relates, generally, to a mattress. More particularly, the present disclosure pertains to a multi-layer mattress to facilitate an uneven compression of the mattress when the person lies on the mattress.

BACKGROUND

Mattresses used for sleeping have been made in more or less the same shape and primary materials for many years. Foam mattresses typically use multiple layers of foam having uniform thickness and often times having identical density and firmness throughout the entire thickness of the layers. Accordingly, foam mattresses may lack the ability to ergonomically support the human form or body, especially when considering the natural arcs and curves of the human forms or the tendency for some people to carry extra weight through their hips, waist and stomach area. The disclosed construction method addresses both the need for contouring support and the ability to enhance the strength of support (or resistance to compression) in one or more areas of the mattress.

SUMMARY

According to an aspect of the disclosure a mattress is disclosed. The mattress Includes a first layer, a second layer supported on the first layer and arranged abutting the first layer, and a third layer having a substantially arch shape. The third layer includes a first portion embedded inside the first layer and a second portion at least partially embedded inside the second layer.

In some embodiments, the first portion of the third layer is a first end portion of third layer and the second portion of the third layer includes a second end portion and a central portion. The central portion extends from the first end portion to the second end portion and defines at least one apex embedded inside the second layer.

In some embodiments, the second end portion is embedded inside the first layer.

In some embodiments, the first end portion extends along a longitudinal side of the mattress from a first longitudinal end of the mattress to the central portion and the second end portion extends from the central portion to a second longitudinal end of the mattress.

In some embodiments, the third layer is arranged symmetrically about a central lateral line mattress.

In some embodiments, the arch shape includes a convex shape having a single apex embedded inside the second layer.

In some embodiments, the apex coincides with a central lateral line of the mattress.

In some embodiments, the apex is arranged at an offset from a central lateral axis of the mattress.

In some embodiments, a first longitudinal end of the third layer is arranged proximate to a first surface of the mattress relative to a second longitudinal end of the third layer.

In some embodiments, the arch shape includes a wavy shape and the central portion defines a plurality of apexes and at least one trough arranged between two consecutive apexes.

In some embodiments, the at least one trough is embedded inside the first layer.

In some embodiments, the second layer is relatively softer than the third layer.

In some embodiments, the mattress further includes a cover layer arranged supported on the second layer such that the second layer is disposed between the first layer and the cover layer.

According to another aspect of the disclosure, a method for manufacturing a mattress is provided. The method includes forming a block having a first layer and a second layer stacked on the first layer. The second layer is softer relative to the first layer. The method also includes dividing the block into two halves by making a cut into the block extending from a first longitudinal end of the block to a second longitudinal end of the block. The cut includes an arch shape and has a first cut portion defined inside the first layer and extending to the second layer from the first longitudinal end of the block, and a second cut portion at least partly defined inside the second layer and extending from the first cut potion towards the second longitudinal end of the block. Moreover, the method includes sandwiching a third layer between the two halves of the block. The third layer extends, at least partly, along contours of the two halves of the block defined by the cut such that a first portion of the third layer is embedded inside the first layer and a second portion of the third layer is, at least partially, embedded inside the second layer.

In some embodiments, the third layer includes at least one apex defined by the second portion of the third layer. The at least one apex is embedded inside the second layer and aligns with at least one peak of the cut.

In some embodiments, the first portion is a first end portion of the third layer and the second portion includes a second end portion and a central portion extending from the first end portion and the second end portion. The central portion defines the at least one apex of the third layer.

In some embodiments, the first end portion extends along contours of the two halves of the block defined by the first cut portion, and the central portion of the third layer extends along the contours of the two halves of the block defined by the second cut portion.

In some embodiments, the cut includes a third cut portion extending from the second cut portion to the second longitudinal end of block. The second end portion of the third layer extends along contours of the two halves defined by the third cut portion.

In some embodiments, the third cut portion is defined inside the first layer and extends to the second layer from the second longitudinal end. The second end portion of the third layer is embedded inside the first layer.

In some embodiments, sandwiching the third layer between two halves of the block includes adhesively attaching the third layer to the two halves of the block.

In some embodiments, the method further includes attaching a cover layer to the second layer such that the second layer is arranged between the first layer and the cover layer.

For a more complete understanding of the present invention, reference is made to the following detailed description and accompanying drawings. In the drawings, like reference characters refer to like parts throughout the views in which.

DETAILED DESCRIPTION

Figure 1:
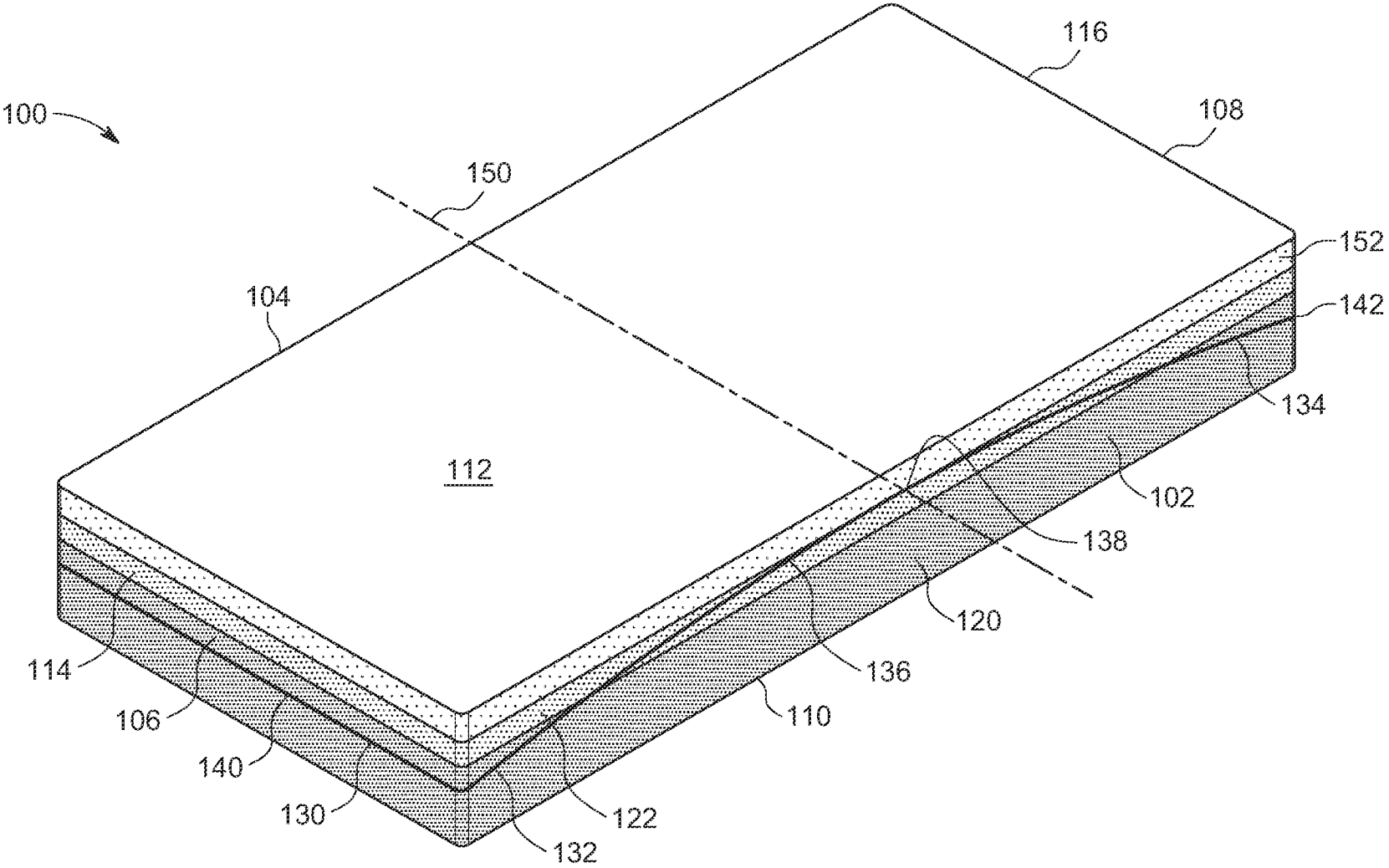
FIG. 1 illustrates a top perspective view of a mattress, in accordance with an exemplary embodiment of the disclosure.

Exemplary embodiments are described below with reference to the accompanying drawings. Unless otherwise expressly stated in the drawings, the sizes, positions, etc., of components, features, elements, etc., as well as any distances therebetween, are not necessarily to scale, and may be disproportionate and/or exaggerated for clarity.

The terminology used herein is for the purpose of describing exemplary embodiments only and is not intended to be limiting. As used herein, the singular forms "a," "an" and "the" are intended to include the plural forms as well, unless the context clearly indicates otherwise. It should be recognized that the terms "comprise," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise specified, a range of values, when recited, includes both the upper and lower limits of the range, as well as any sub-ranges therebetween. Unless indicated otherwise, terms such as "first," "second," etc., are only used to distinguish one element from another. For example, one element could be termed a "first element" and similarly, another element could be termed a "second element," or vice versa. The section headings used herein are for organizational purposes only and are not to be construed as limiting the subject matter described.

Unless indicated otherwise, the terms "about," "thereabout," "substantially," etc., mean that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art.

Spatially relative terms, such as "right," "left," "below," "beneath," "lower," "above," and "upper," and the like, may be used herein for ease of description to describe one element's or feature's relationship to another element or feature, as illustrated in the drawings. It should be recognized that the spatially relative terms are intended to encompass different orientations in addition to the orientation depicted in the figures. For example, if an object in the figures is turned over, elements described as "below" or "beneath" other elements or features would then be oriented "above" the other elements or features. Thus, the term "below" can, for example, encompass both an orientation of above and below. An object may be otherwise oriented (e.g., rotated 90 degrees or at other orientations) and the spatially relative descriptors used herein may be interpreted accordingly.

Unless clearly indicated otherwise, all connections and all operative connections may be direct or indirect. Similarly, unless clearly indicated otherwise, all connections and all operative connections may be rigid or non-rigid.

Like numbers refer to like elements throughout. Thus, the same or similar numbers may be described with reference to other drawings even if they are neither mentioned nor described in the corresponding drawing. Also, even elements that are not denoted by reference numbers may be described with reference to other drawings.

Many different forms and embodiments are possible without deviating from the spirit and teachings of this disclosure and so this disclosure should not be construed as limited to the exemplary embodiments set forth herein. Rather, these exemplary embodiments are provided so that this disclosure will be thorough and complete, and will convey the scope of the disclosure to those skilled in the art.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments.

Reference will now be made in detail to specific embodiments or features, examples of which are illustrated in the accompanying drawings. Generally, corresponding reference numbers will be used throughout the drawings to refer to the same or corresponding parts. Also, wherever possible, the same reference numbers will be used throughout the drawings to refer to the same or the like parts.

Figure 2:
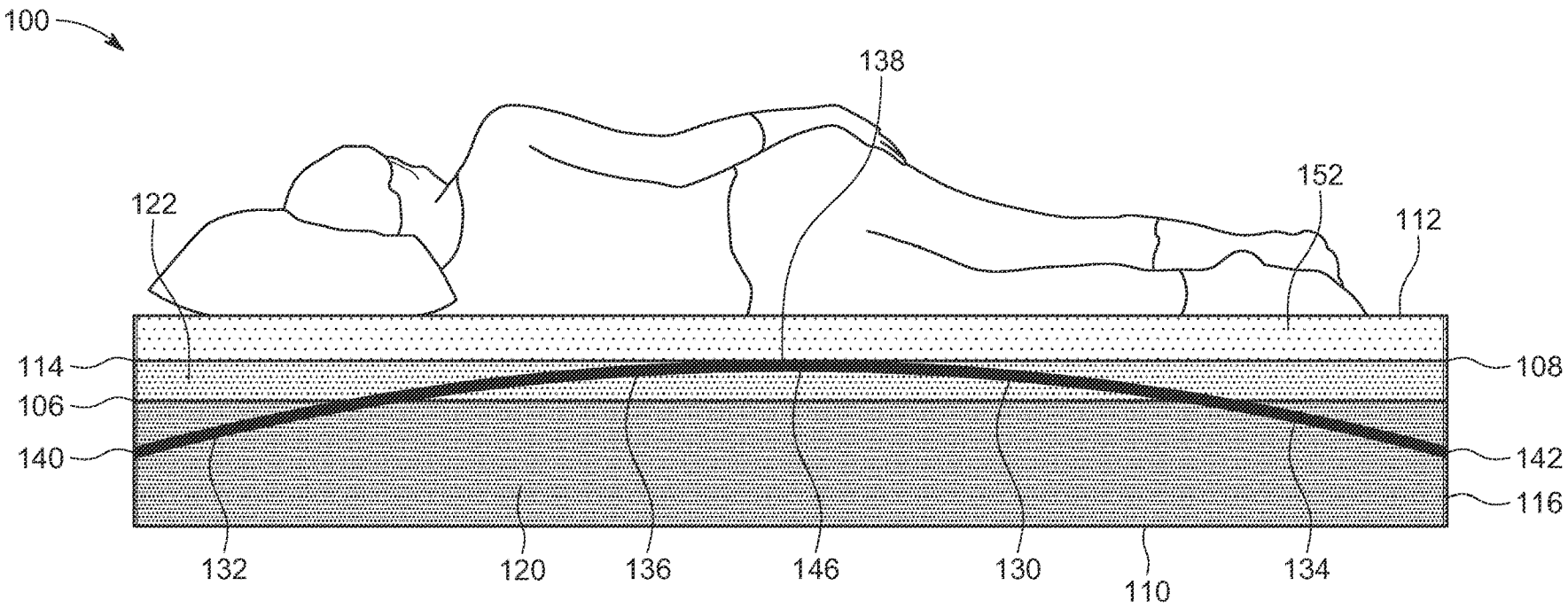
FIG. 2 illustrates a side view of the mattress of FIG. 1, in accordance with an exemplary embodiment of the disclosure.
Figure 3:
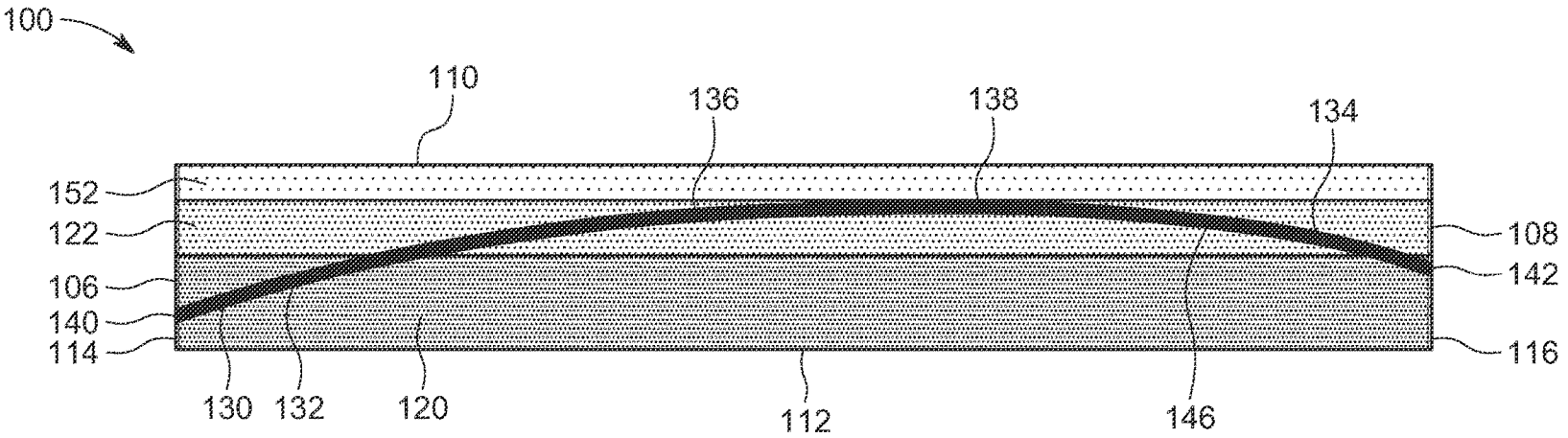
FIG. 3 illustrates a side view of a mattress having an apex of a third layer of the mattress arranged at an offset from a central lateral line of the mattress, in accordance with an exemplary embodiment of the disclosure.

Referring to FIGS. 1 to 3, a mattress 100 is shown according to exemplary embodiments of the disclosure. The mattress 100 may be a rectangular mattress having a pair of longitudinal sides 102, 104 and a pair of lateral sides 106, 108 extending between the pair of longitudinal sides 102, 104. The mattress 100 also includes a first surface 110 adapted to contact a surface, for example, a bed or a ground, and a second surface 112 arranged opposite to the first surface 110. The user lies on the second surface 112 of the mattress 100. Further, the mattress 100 includes a first longitudinal end 114 and a second longitudinal end 116 arranged opposite to the first longitudinal end 114. The longitudinal sides 102, 104 of the mattress 100 extend from the first longitudinal end 114 to the second longitudinal end 116.

As shown, the mattress 100 includes a first layer 120 (i.e., a base layer 120) defining a support layer of the mattress 100 and a second layer 122 arranged contacting the base layer 120 and supported on the base layer 120. In an embodiment, the second layer 122 is adhesively attached to the base layer 120. In some embodiments, the second layer 122 is a soft layer relative to the base layer 120 and may be made of foam, for example, polyurethane form. Similarly, the base layer 120 may also be made of the foam, for example, polyurethane form, or a coconut coir. Both the base layer 120 and the second layer 122 extend from a first longitudinal side 102 to a second longitudinal side 104 of the mattress 100 and extend from a first lateral side 106 to a second lateral side 108 of the mattress 100.

The mattress 100 includes a third layer 130 arranged between the base layer 120 and the second layer 122 and is relatively harder than the second layer 122. In an embodiment, the first layer 120 is harder than the third layer 130 and the third layer 130 in anchored inside the first layer 120. The third layer 130 extends in a curved shape or arch shape, and is arranged partially within the base layer 120 and partially within the second layer 122. As shown, the third layer 130 extends from the first longitudinal end 114 of the mattress 100 to the second longitudinal end 116 of the mattress 100 and includes a first end portion 132 embedded inside the base layer 120, a second end portion 134 arranged/embedded inside the base layer 120, and a central portion 136 extending from the first end portion 132 to the second end portion 134 and includes at least one apex, for example, an apex 138, arranged/embedded inside the second layer 122. Accordingly, the second end portion 134 and the central portion 136 together define a second portion of the third layer 130. Further, the third layer 130 includes a first longitudinal end 140 arranged proximate or aligned with the first longitudinal end 114 of the mattress 100 and a second longitudinal end 142 arranged proximate or aligned with the second longitudinal end 116 of the mattress 100. As shown, the first end portion 132 extends from the first longitudinal end 140 to the central portion 136, while the second end portion 134 extends from the second longitudinal end 142 to the central portion 136. Although, the third layer 130 is shown to be extended from the first longitudinal end 114 of the mattress 100 to the second longitudinal end 116 of the mattress 100, it may be envisioned that the first longitudinal end 140 and/or the second longitudinal end 142 of the third layer 130 may be arranged at offset from the first longitudinal end 114 and the second longitudinal end 116 of the mattress 100 respectively.

As shown in FIGS. 1 to 3, the first end portion 132 extends towards the second surface 112 of the mattress 100 from the first longitudinal end 140 in an arch shape such that a distance of a lower surface 146 of the third layer 130 from the first surface 110 increases from the first longitudinal end 142 to the central portion 136. It can be seen that the first end portion 132 is completely embedded or anchored within the base layer 120. Similar to the first end portion 132, the second end portion 134 extends towards the second surface 112 of the mattress 100 from the second longitudinal end 142 in an arch shape such that a distance of the lower surface 146 of the third layer 130 from the first surface 110 of the mattress 100 increases from the second longitudinal end 142 to the central portion 136. It can be seen that the second end portion 134 is completely embedded or anchored within the base layer 120. Although both the first end portion 132 and the second end portion 134 are contemplate and shown to be embedded inside the first layer 120, it may be envisioned that only one of the first end portion 132 and the second end portion 134 may be embedded inside the first layer 120, and other of the first end portion 132 and the second end portion 134 may be embedded inside the second layer 122.

As shown in FIGS. 1 to 3, the third layer 130 includes a substantially convex shape having the central portion 136 completely arranged or embedded inside the second layer 122. Accordingly, the third layer 130 is arranged such that a distance of the lower surface 146 of the third layer 130 increases from the first longitudinal end 140 of the third layer 130 to the apex 138 and then decreases from the apex 138 to the second longitudinal end 142 of the third layer 130. As illustrated in FIGS. 1 and 2, the apex 138 is arranged along a central lateral line 150 of the mattress 100 and the third layer 130 is symmetrically about the central lateral line 150 or the apex 138. In some embodiments, as shown in FIG. 3, the apex 138 is arranged offset from the central lateral line 150 of the mattress, and the third layer 130 may be asymmetrically arranged about the central lateral line 150 and/or the apex 138. In one embodiment, one of the longitudinal ends, for example, the first longitudinal end 140, may be arranged proximate to the first surface 110 of the mattress 100, while other of the longitudinal end, for example, the second longitudinal end 142, is arranged distally from the first surface 110 of the mattress 100 relative to the first longitudinal end 140. In an embodiment, at one of the longitudinal ends 140, 142 of the third layer 100 is arranged at the lower surface (i.e., first surface 110) of the mattress 100. Additionally, or optionally, the mattress 100 may include a cover layer 152 arranged supported on the second layer 122 such that the second layer 122 is arranged between the first layer 120 and the cover layer 152. Although, the third layer 130 is shown to be extending in two adjacent layers, it may be appreciated that the third layer 130 may extend in any number of layers of the mattress 100 that has more than three layers.

Figure 4:
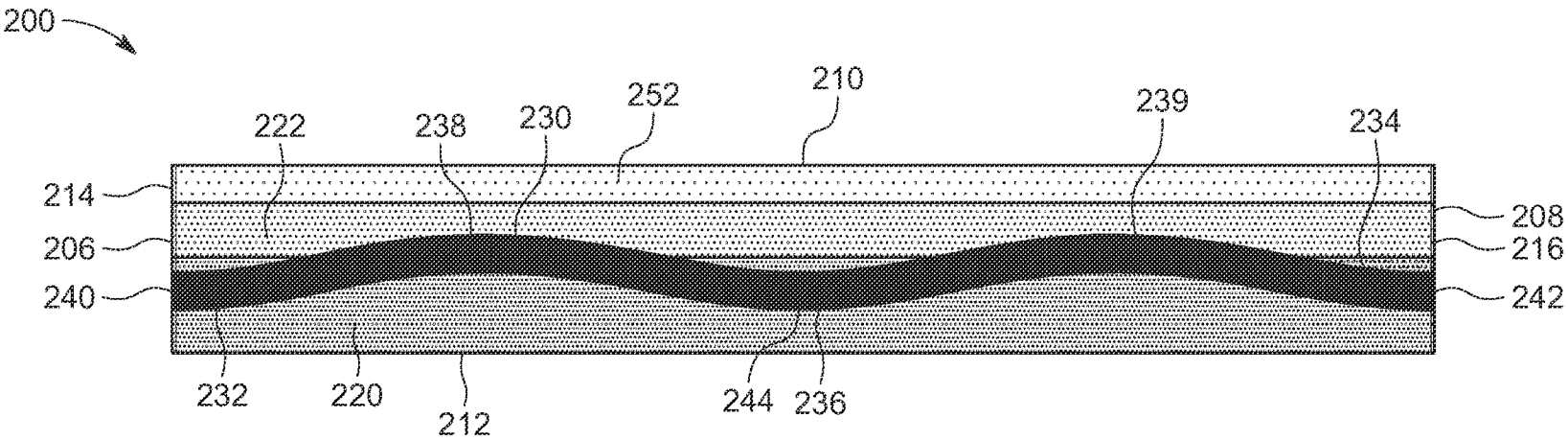
FIG. 4 illustrates a side view of a mattress, in accordance with an exemplary embodiment of the disclosure.

Referring to FIG. 4, a mattress 200 according to an alternative embodiment is shown. The mattress 200 is similar to the mattress 100 except that a third layer 230 of the mattress 200 is different from the third layer 130 of the mattress 100. The mattress includes a first longitudinal side, a second longitudinal side, a first lateral side 206, a second lateral side 208, a first surface 210, a second surface 212, a first longitudinal end 214, and a second longitudinal end 216 similar to the first longitudinal side 102, the second longitudinal side 104, the first lateral side 106, the second lateral side 108, the first surface 110, the second surface 112, the first longitudinal end 114, and the second longitudinal end 116 respectively. Moreover, the mattress 200 includes a first layer 220 (i.e., a base layer 220) and a second layer 222 similar to the first layer 120 and the second layer 122 of the mattress 100.

As shown, the third layer 230 includes a wavy shape having first portion, i.e., a first end portion 232 embedded inside the base layer 220, a second end portion 234 embedded inside the base layer 220, and a central portion 236 arranged between the first end portion 232 and the second end portion 234. Accordingly, the second end portion 232 and the central portion 236 together define the second portion of the third layer 230. The first end portion 232 extends from a first longitudinal end 240 of the third layer 230 to the central portion 236, while the second end portion 234 extends from a second longitudinal end 242 of the third layer 230 to the central portion 236. The first longitudinal end 240 of the third layer 230 is arranged proximate to or in alignment with the first longitudinal end 214 of the mattress 200 and the second longitudinal end 242 of the third layer 230 is arranged proximate to or in alignment with the second longitudinal end 216 of the mattress 200.

The central portion 236 may include a plurality of apexes, for example, a first apex 238 and a second apex 239, embedded or arranged inside the second layer 222. The first apex 238 is arranged proximate to the first longitudinal end 240 of the third layer 230, and hence the first longitudinal end 214 of the mattress 200, relative to the second longitudinal end 242 of the third layer 230, and hence the second longitudinal end 216 of the mattress 200. The second apex 239 is arranged at a longitudinal distance from the first apex 238 and may be disposed proximate to the second longitudinal end 242 relative to the first longitudinal end 240. As with the third layer 130, the first end portion 232 and the second end portion 234 are embedded completely inside the first layer 220 and include arcuate shapes. Further, the central portion 236 defines/includes at least one trough arranged between two consecutive apexes, for example, a trough 244 arranged between the first apex 238 and the second apex 239 and embedded inside the base layer 220.

Accordingly, the third layer 230 extends towards the second surface 212 of the mattress 200 from the first longitudinal end 214 of the third layer 230 till the first apex 238 in an arc shape, and then extends downwardly, i.e., towards the first surface 210 of the mattress 200 till the trough 244 in an arc shape. Subsequently, the third layer 230 extends upwardly, i.e., towards the second surface 212 from the trough 244 to the second apex 239 in an arch shape, and then gradually extends downwardly i.e., towards the first surface 210 from the second apex 239 to the second longitudinal end 242 of the third layer 230.

In the illustrated embodiments, the first longitudinal end 240 and the second longitudinal end 242 of the third layer 230 coincide/align with the first longitudinal end 210 and the second longitudinal end 216 of the mattress 200, respectively. However, it may be envisioned that the first longitudinal end 240 and the second longitudinal end 242 of the third layer 230 may be arranged inwardly and at an offset from the first longitudinal end 210 and the second longitudinal end 216 of the mattress 200 respectively. Also, the third layer 230 may be arranged symmetrically or asymmetrically about a central lateral line of the mattress 200. Although both the first end portion 232 and the second end portion 234 are contemplate and shown to be embedded inside the first layer 220, it may be envisioned that only one of the first end portion 232 and the second end portion 234 may be embedded inside the first layer 220, and other of the first end portion 232 and the second end portion 234 may be embedded inside the second layer 222. Additionally, or optionally, the mattress 200 may include a cover layer 252 arranged supported on the second layer 222 such that the second layer 222 is arranged between the first layer 220 and the cover layer 252.

Figure 5:
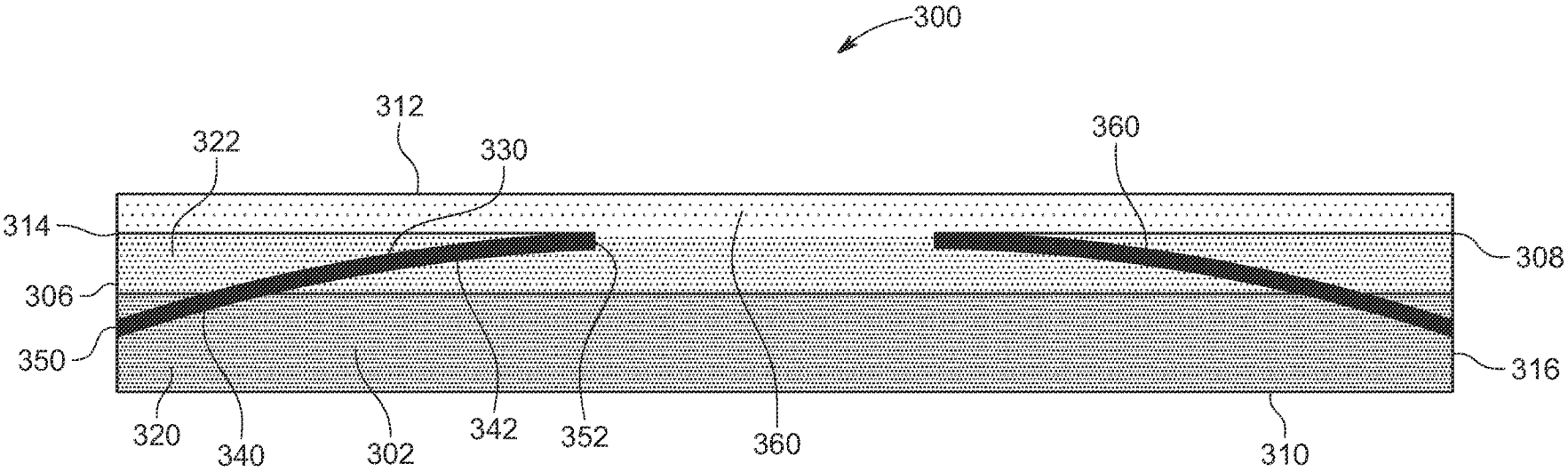
FIG. 5 illustrates a side view of a mattress, in accordance with an exemplary embodiment of the disclosure.

Referring to FIG. 5, a mattress 300 according to an alternative embodiment is shown. The mattress 300 is similar to the mattress 100 except that a third layer 330 of the mattress 300 is different from the third layer 120 of the mattress 100. The mattress 300 includes a first longitudinal side 302, a second longitudinal side (not shown), a first lateral side 306, a second lateral side 308, a first surface 310, a second surface 312, a first longitudinal end 314, and a second longitudinal end 316 similar to the first longitudinal side 102, the second longitudinal side 104, the first lateral side 106, the second lateral side 108, the first surface 110, the second surface 112, the first longitudinal end 114, and the second longitudinal end 116 of the mattress 100 respectively. Moreover, the mattress 300 includes a first layer 320 (i.e., a base layer 320) and a second layer 322 similar to the first layer 120 and the second layer 122 of the mattress 100 respectively.

As shown, the third layer 330 includes a first portion 340 disposed proximate to the first lateral side 306 and embedded inside the base layer 320 and a second portion 342 extending upwardly from the first portion 340 and embedded inside the second layer 322. As illustrated, the third layer 330 is in form an arc defining a sector of a circle. As shown, a first end 350 of the third layer 330 is arranged at the first longitudinal end 314 of the mattress 300, while a second end 322 of the third layer 330 of the mattress 300 is arranged proximate to an upper surface of the second layer 322. Accordingly, the second end 352 may define an apex of the third layer 330. Also, the mattress 300 may include a fourth layer 360 similar to the third layer 330. As shown, the third layer 330 and the fourth layer 360 are arranged symmetrically on the opposing sides of a central lateral line of the mattress 300.

Figure 6:
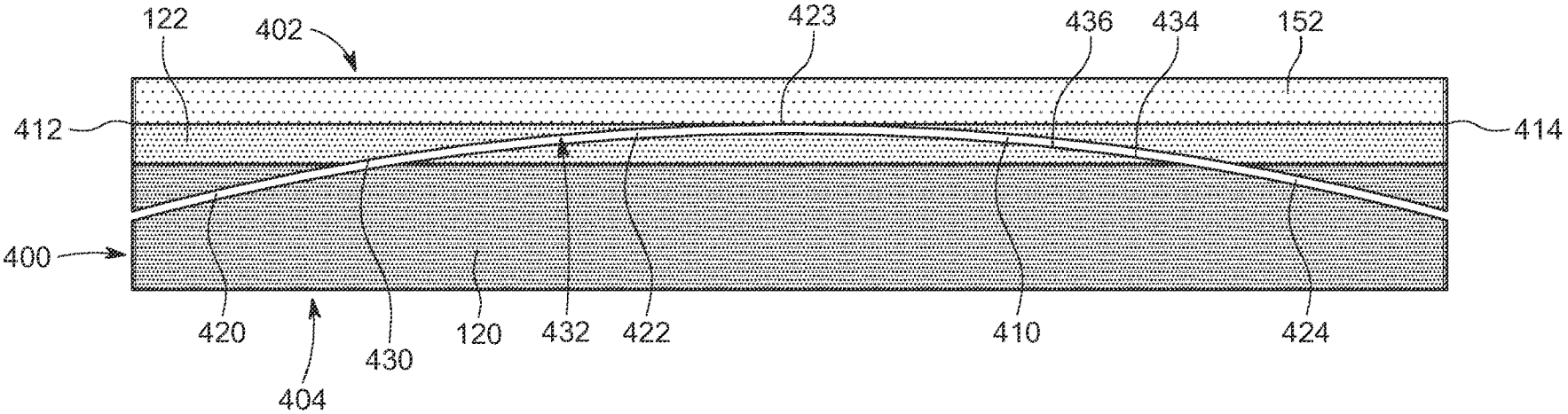
FIG. 6 illustrates a block cut into two halves during manufacturing of the mattress of FIG. 1, in accordance with an exemplary embodiment of the disclosure.

A method of manufacturing the mattress 100 is now described and it may be appreciated that the mattress 200 and the mattress 300 may be similarly manufactured. For manufacturing the mattress 100, the first layer 120 of suitable material and the second layer 122 of suitable material is provided. Thereafter, the second layer 122 is stacked on the first layer 120 and is adhesively attached to the first layer 120 to form a block 400. Thereafter, as shown in FIG. 6, the block 400 is divided into two halves, an upper half 402 and a lower half 404, by making a cut 410 through the block 400 from a first longitudinal end 412 of the block 400 to a second longitudinal end 414 of the block 400. Referring to FIG. 6, the cut 410 includes an arch shape, for example, convex shape, having a first cut portion 420 extending inside the first layer 120 from the first longitudinal end 412 to the second layer 122 in an upward direction and in an arcuate manner, a second cut portion 422 arranged at least partly inside the second layer 122 and extending from the first cut portion 420 towards the second longitudinal end 414 of the block 400, and a third cut portion 424 extending from the second cut portion 422 to the second longitudinal end 414 of the block 400.

In an embodiment, the second cut portion 422 defines at least one peak 423 of the cut 410. In the illustrated embodiment, the third cut portion 424 extends inside the first layer 120 from the second cut portion 422 to the second longitudinal end 414 in a downward direction. However, it may be appreciated that the third cut portion 424 may be a straight cut and extends horizontally. In such a case, the third cut portion 424 may be defined inside the second layer 122 or at an interface of the first layer 120 and the second layer 122. In some embodiments, the third cut portion 424 may be omitted and in such a case, the second cut portion 322 extends completely inside the second layer 122 from the first cut portion 420 to the second longitudinal end 414.

Accordingly, a lower surface 430 of the upper half 402 of the block defines at least one valley, for example, a convex groove 432, while an upper surface 434 of the lower half 404 of the block 400 defines at least one protrusion, for example, a convex protrusion 436. Subsequently, the third layer 130 is sandwiched between the two halves 402, 404 of the block 400 such that the third layer 130 follows the contour of the upper surface 434 of the lower half 404 and contour of the lower surface 430 of the upper half 402 of the block 400 defined by the cut 410. The third layer 130 is sandwiched between the two halves 402, 404 such that first end portion 132 of the third layer 130 extends along the contours of the two halves 402, 404 defined by the first cut portion 420, while the central portion 136 of the third layer 130 extends along the contours of the two halves 402, 404 defined by the second cut portion 422. Accordingly, the first end portion 132 of the third layer 130 is embedded inside the first layer 120 and the apex 138 defined by the central portion 136 is embedded inside the second layer 122.

Although the central portion 136 is shown to be completely embedded inside the second layer 122 due to the convex shape of the third layer 130, it may be envisioned that the central portion 136, in other embodiments, may be embedded partly inside the first layer 120 and partly inside the second layer 122 as in the mattress 200. Further, the third layer 130 is arranged between the two halves 402, 404 such that the second end portion 134 of the third layer 130 extends along the contours of the two halves 402, 404 defined by third cut portion 424. In some embodiments, the second end portion 134 may be arranged completely inside the second cut portion 422 and therefore, may be embedded inside the second layer 122. In an embodiment, the third layer 130 is adhesively attached with both the upper surface 434 of the lower half 04 of the block 400 and the lower surface 430 of the upper half 402 of the block 400. Accordingly, the third layer 130 is arranged in an arch shape inside the mattress 100. Additionally, or optionally, the cover layer 152 may be attached to the second layer 122. In an embodiment, the cover layer 152 may be attached before making the cut 410. Alternatively, the cover layer 152 may be attached to the second layer 122 after making the cut 410 and after embedding the third layer 130 between two halves 402, 404 of the block 400.

While the user is lying on the mattress 100, 200 300, the arch shape of the third layer 130, 230, 330 facilitates uneven compression of the mattress 100, 200, 300. As the user lies on the second surface 112, 212 of the mattress 100, 200, 300 the hips of the user press down the second layer 122, 222 and the third layer 130, 230, deflecting the third layer 130, 230 arranged below the hip area downwardly. Due to the arch shape of the third layer 130, 230 and anchoring of the first end portion 132, 232 and/or the second end portion 134, 234 inside the first layer 120, 220, a portion of the third layer 130, 230, arranged adjacently to a portion of the third layer 130, 230 being pushed downward by the hip area of the user, will have a tendency to move upwardly providing additional support to the lumbar area of the person. When the user is lying on their side, the third layer 130, 230 will push up into the waist—creating a bit of a cradling effect.

It should be understood that the foregoing description is only illustrative of the aspects of the disclosed embodiments. Various alternatives and modifications can be devised by those skilled in the art without departing from the aspects of the disclosed embodiments. Accordingly, the aspects of the disclosed embodiments are intended to embrace all such alternatives, modifications, and variances that fall within the scope of the appended claims. Further, the mere fact that different features are recited in mutually different dependent or independent claims does not indicate that a combination of these features cannot be advantageously used, such as a combination remaining within the scope of the aspects of the disclosed embodiments.

Various aspects of the disclosure have been described above. It should be apparent that the teachings herein may be embodied in a wide variety of forms and that any specific structure, function, or both being disclosed herein is merely representative. Based on the teachings herein one skilled in the art should appreciate that an aspect disclosed herein may be implemented independently of any other aspects and that two or more of these aspects may be combined in various ways. For example, an apparatus may be implemented or a method may be practiced using any number of the aspects set forth herein. In addition, such an apparatus may be implemented or such a method may be practiced using other structure, functionality, or structure and functionality in addition to or other than one or more of the aspects set forth herein.

What is claimed is:

1. A mattress, comprising:

a first layer;

a second layer supported on the first layer and arranged abutting the first layer; and a third layer including a first longitudinal end and a second longitudinal end and having a substantially arch shape, the third layer including a first portion extending in a longitudinal direction from a location proximate to the first longitudinal end towards the second longitudinal end and completely embedded, in a vertical direction, inside the first layer and a second portion extending in a longitudinal direction from the first portion towards the second longitudinal end, wherein at least a part of a length of the second portion is completely embedded, in the vertical direction, inside the second layer.

2. The mattress of claim 1, wherein the first portion is a first end portion of third layer and the second portion of the third layer includes a second end portion and a central portion extending from the first end portion to the second end portion, wherein the central portion defines at least one apex embedded inside the second layer, and at least a part of a length of the central portion is completely embedded inside the second layer.

3. The mattress of claim 2, wherein the second end portion is completely embedded inside the first layer.

4. The mattress of claim 2, wherein the first end portion extends along a longitudinal side of the mattress from a first longitudinal end of the mattress to the central portion and the second end portion extends from the central portion to a second longitudinal end of the mattress.

5. The mattress of claim 2, wherein the third layer is arranged symmetrically about a central lateral line of the mattress.

6. The mattress of claim 2, wherein the arch shape includes a convex shape having a single apex embedded inside the second layer.

7. The mattress of claim 6, wherein the apex coincides with a central lateral line of the mattress.

8. The mattress of claim 6, wherein the apex is arranged at an offset from a central lateral axis of the mattress.

9. The mattress of claim 2, wherein the arch shape includes a wavy shape, and the central portion defines a plurality of apexes and at least one trough arranged between two consecutive apexes.

10. The mattress of claim 9, wherein the at least one trough is embedded inside the first layer.

11. The mattress of claim 1, wherein the first longitudinal end of the third layer is arranged proximate to a first surface of the mattress relative to the second longitudinal end of the third layer.

12. The mattress of claim 1, wherein the second layer is softer with respect to the third layer.

13. The mattress of claim 1 further including a cover layer arranged supported on the second layer such that the second layer is disposed between the first layer and the cover layer.

* * * * *